United States Patent [19]

Yulkowski

[11] 3,969,845

[45] July 20, 1976

[54] DOOR CONSTRUCTION

[76] Inventor: Leon Yulkowski, 4390 Derry Road, Bloomfield Hills, Mich. 48013

[22] Filed: Dec. 9, 1974

[21] Appl. No.: 530,958

[30] Foreign Application Priority Data

Feb. 11, 1974 Germany ..... 2406428

[52] U.S. Cl. ..... 49/394; 49/278; 292/216; 49/367; 292/78; 292/DIG. 31

[51] Int. Cl.[2] ..... E05B 65/06

[58] Field of Search..... 49/394, 276, 278, 366–369; 292/216, 218, 78, DIG. 31; 16/DIG. 13

[56] References Cited

UNITED STATES PATENTS

| | | | |
|---|---|---|---|
| 1,504,967 | 8/1924 | Orendorff | 292/DIG. 72 |
| 2,319,403 | 5/1943 | Hill | 49/394 X |
| 3,445,052 | 5/1969 | Lewallen | 16/DIG. 13 |

*Primary Examiner*—Kenneth Downey
*Attorney, Agent, or Firm*—Cullen, Settle, Sloman & Cantor

[57] ABSTRACT

A door hinged in a frame at one edge has a pivotal locking element along its other edge, with a longitudinal groove cooperatively receiving a counter-locking projection on the frame. The locking element includes a rotation stop to prevent the rotation of the door beyond closed position. The locking element is sufficiently rotatable about its pivotal mounting that its groove is disengaged from the locking projection for opening the door. A spring interconnects the locking element and the door for biasing the locking element in open or closed position. Grips are fastened respectively on one side of the door and to the locking element on the other side of the door. The rotation stop has an angularly arranged plate extending into an opening in the door with a projection on its free edge registerable with a corresponding projection on the door to limit opening pivotal movements of the locking element. A blocking element normaly biased to retain the locking element against pivotal movement is manually movable from one or both sides of the door to an unblocking position. The door hinge includes a flexible plastic strip anchored respectively to the door and door frame.

15 Claims, 6 Drawing Figures

DOOR CONSTRUCTION

SUMMARY OF THE INVENTION

The invention concerns a door with a linkage attached to the door frame and with a locking part on its opening side.

Doors of a different form and construction are known which are either not sufficiently burglar-resistant or can be made burglar-resistant only by large expenditures in its manufacture or in its mounting.

The objective of the above invention is to produce an attractively designed door, manufacturable and installable in an economical manner, which allows burglar-resistant locking.

These objectives are thereby achieved in accordance with the invention when the locking part consists of one (of many possible) movably connected locking element extending at least a part of the height of the door, whose joint is arranged in the area of an outer face of the door, and which exhibits on its face a grooved element, which works with a corresponding counter element upon the door frame and that the locking element is supplied with a rotation stop, which prevents its rotation beyond the closing attitude, and that the locking element sufficiently rotatable about the joint in its open attitude so that it is released from the engagement formed by the groove and counter element and that means are supplied which holds the locking element in its open or secured attitude, and which permits a rotation after overcoming a resistance.

The accordingly invented door always allows opening in one direction through swinging of the locking element and locking through a return swinging. A swinging of the locking element past the locking position is avoided by means of a linkage stop. In the unlocked condition, the door can be opened by means of a simple push or pull, whereby the locking element is swung into its open position. Upon closing of the door, the locking element engages the counter element attached to the door frame, by which it is swung into its locked position. The accordingly invented door locks in a burglar-proof way by means of a simple locking of the locking element in its locked position.

Appropriately, the locking element runs the full height of the door. In this way, the door has a uniform (coherent) appearance and the groove, as well as the counter element, allows distribution of the load over the full door height.

The locking element can exhibit on its face side a longitudinally running groove or a longitudinally running projection, which works together with a corresponding groove or projection planned for the door frame, running substantially the full height of the door. The rotation stop can thereby be formed in that the locking element continues beyond the joint towards the hinge exhibiting a flat shaped projection, which bears against one of the door faces when the door is closed.

A biasing means is appropriately planned attached on one side to the door and on the other side to the locking element, which holds the locking element in its closed or open position after rotation through the dead point, that the biasing means holding the locking element in a rest position consists appropriately of a compression means. It can also be a snap or friction element which secures the locking element in the open or locked position.

The rotation stop formed by the flat shaped continuation can have a gripping element on its end and, on the door in the area of the gripping element, a recess permitting gripping. Appropriately, the flat shaped continuation has an angular plate attached which covers the crack formed by the swinging of the flat shaped continuation between itself and the door, so that any danger of injury from use is eliminated. The plate can be shaped into a curved form, corresponding to the swing radius and be provided on its end edge with a projection which cooperatively engages an opposingly oriented hook-like projection arranged on the door to limit the rotation angle of the locking element.

A gripping element can also be formed on the opposite side of the door. The locking element consists appropriately of a box-like profile with projections on both sides, whereby the face projections form an enclosing groove for the locking member fastened to the door frame. For locking of the door, a movable blocking member can be provided which blocks the locking member in its closed position. The locking can consist of a blocking member which is arranged in the door in a vertical axis swingable between its locked position in which it is braced in its length against a part of the locking element, and in its unrestricting position relative to the locking element. The blocking member can also be held in a guide and be movable between its blocking position and the free position. The blocking element can be biased in its locked position by means of a spring or other means, or be urged into this condition, so that the door becomes automatically locked upon closing.

An operable means can be provided on one or both sides of the door, whereby the locking element can be rotated to its unblocking position. The blocking element can be biased into its unblocking position from one or from both sides of the door by means of cams. The cams can be fastened to a horizontally oriented shaft within the door, whereby the locking element is rotatable to its unblocking position by the projections attached to the cams on the shaft operable by grips on one or both sides of the door, attached to the shaft. The blocking element is also rotatable to its unblocking position through built-in cylinders of a known kind.

In a further arrangement of the invention, the door hinge consists of an elastic plastic profile attached to the door frame, that exhibits a stripped shape, which is attached to the door. Appropriately, it follows that the attachment occurs in the base of the channel formed on the edge of the door by the lateral projections which (i.e., hinge) is connected to the strip attached to the door frame. The attachment of the plastic profile to the door frame is appropriately accomplished by means of a U-shaped steel profile which lays in the groove formed by the laterally extended projections (on the door) so that the door cannot be illegally opened by moving the door out of the area of the hinge by cutting the strip-shaped extension.

The locking element can also consist of a round profile with a protrusion serving as an abutment means or of a round profile with a segment removed.

The movable profile is appropriately manufactured as an extrusion.

The accordingly invented door exhibits numerous advantages. Its outer appearance is very attractive because it is uniform and evenly formed. The door exhibits no projections on which one can be injured.

The manufacturing cost of the door is minimized because lock cases, knobs and other customary hardware can be eliminated. The door can be mounted right or left handed in its frame by turning (the door) in known ways in whatever hand is desired. It can be cut to the needed length by cutting in customary ways without interfering with its function.

Customary carpenter work is eliminated in installation or mounting of the door. The door is completely and economically manufactured in the factory and can be packed in a very small volume for shipping because this door has no or only insignificant projections and, therefore, can be stacked one on top of the other. The good packing possibilities of the door is an advantage for shipping and dispatch.

The door can be completely finished in all details in the factory, simplifying greatly its installation. It requires only to be fastened in its frame by means of screws, namely, only the hinge and closing elements must be fastened.

The door is burglar-proof (resistant) since the frame cannot be simply spread apart by force, permitting unauthorized entry because the door is substantially engaged in the closing element over its full height. The door does not allow opening by use of force, example — kicking, because the pressure is distributed over the height of the locking and blocking elements, and therefore, can withstand substantial forces. Also the door does not permit opening by means of a pry-bar because the door cannot be removed from its engagement over its full height. The door offers special protection against explosive forces because of its high disengagement resistance.

On the accordingly invented door, on the other side, there is exhibited in a simple way, an actuator by which the blocking element can be swung to its unblocking position, so that the accordingly invented door can fulfill all the requirements of an emergency exit.

The door invention is especially suited for installation in schools, churches and offices.

Sample configurations of the invention are further clarified with the help of the following drawings.

THE DRAWINGS

DETAILED DESCRIPTION OF THE INVENTION

Figure 1:
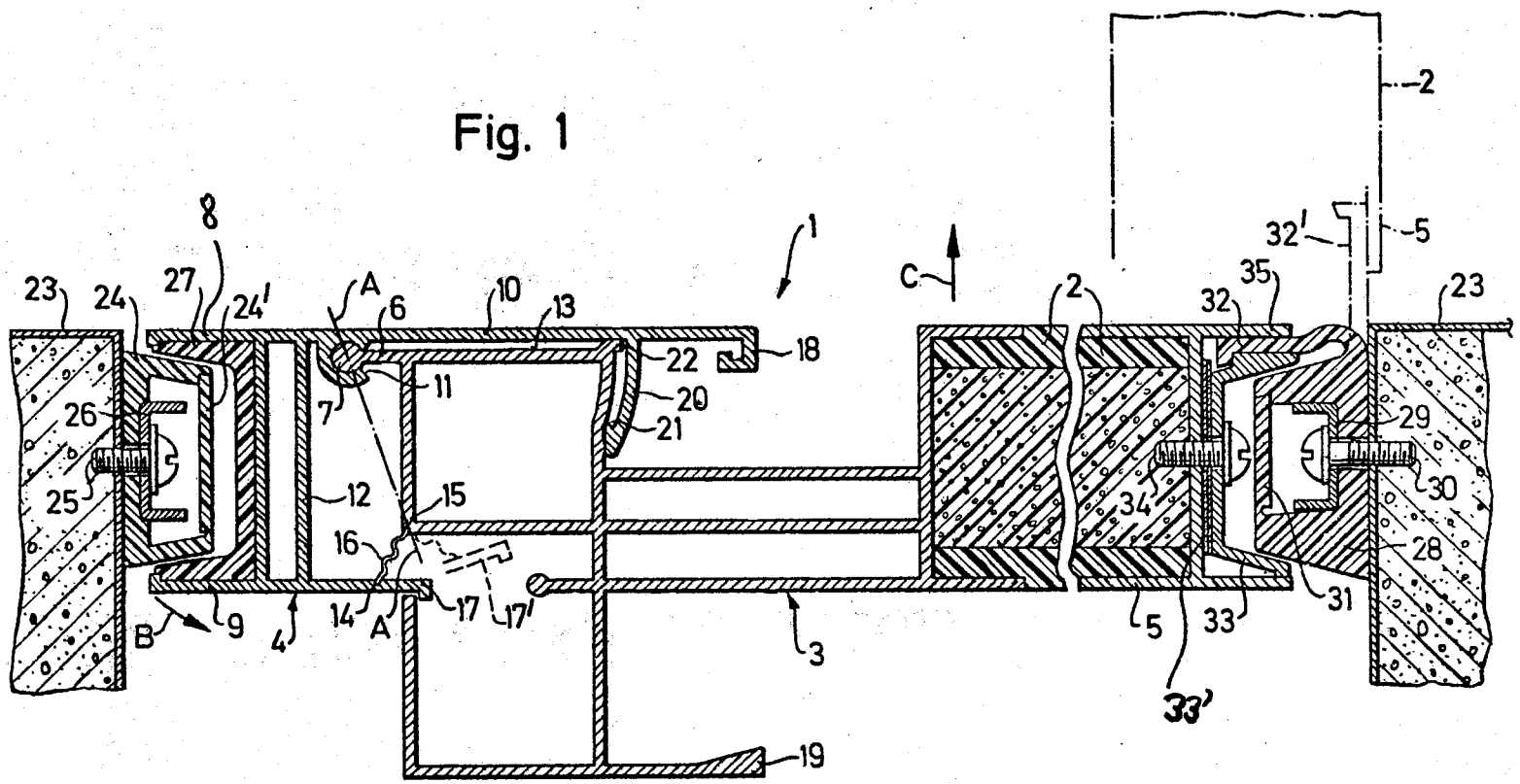
FIG. 1 is a section through the door.

The door 1 consists of a central door section 2 which can be manufactured out of wood, plastic sheets with a foam core, sandwich core reinforced plates and in other materials in known customary ways. The profile bracket 3 is attached on the opening side of the door on the flat shaped central part 2. The bracket 3 exhibits a profile which provides a significant stiffness in its longitudinal axis.

The shaped locking element 4 is linked to the profile bracket 3.

A double T-formed bracket 5 is fastened to the hinge side of the central door section 2.

The profile bracket 3 exhibits in the area of the outer side of the door, a projection 6 with a roll 7 with a circular cross section, on the appropriate side of which is arranged the locking element 4. This roll 7 serves as the hinge axis for the locking element 4. The locking element 4 consists of a box-like bracket which has formed on one side the U-formed groove, formed by means of projections 8 and 9. The projection 8 is continued as a flat shaped part 10 in the direction of the door hinge. This flat shaped part exhibits in the area of projections 8 and 9 and connecting leg 12 a curve-shaped element 11 which encloses the linkage axis formed by roll 7 on the bracket 3. The locking element is rotatable around the joint 7–11 in the direction of arrow B. The rotation of the locking element 4 in the opposite direction is thereby limited as the flat shaped part 10 lays against surface 13 of bracket 3 and a further rotation is stopped. A compressive resiliant means (spring 16) is movably fastened at point 15 on bracket 3 and at point 14 on the locking element 4. By rotation of the locking element 4, the connecting point 14 of spring 16 on projection 17 is moved through line A—A to the locking element position shown in dotted lines so that stability is again achieved after spring 16 passes through its dead position. In FIG. 1, the locking element 4 is shown in its stable latched position. By opening of the door through rotation of locking element 4 in the direction of arrow B, the locking element 4 assumes a stable open attitude with projection 17 laying in the dotted position 17'.

The flat shaped part 10 exhibits on its door hinge side a gripping element 18. In a corresponding manner the profile bracket 3 has on the opposite side of the door, a gripping element 19. In the profile section under each of the gripping elements 18 and 19, space is left free so that the gripping members can be comfortably gripped.

The flat shaped part 10 is provided with a projection 20 directed inwardly against the door, which upon opening of the door, covers the crack between the flat shaped part 10 and the opposing surface 13. The leg 20 exhibits on its end a projection 21, which upon rotation of the locking element 4, strikes against an opposing projection 22 on the profile bracket 3 and thereby limits the angle of rotation of the locking element 4.

A locking element 24 is screwed onto the door frame 23. As one example, this consists of an extruded elastic plastic profile 24, which is screwed to the door frame 23 by means of a U-shaped bracket 26 and screws 25. The fastening is covered by the tongue 24 so that the closing element presents an attractive appearance. In order to provide a good seating of the locking element the door is provided with a U-shaped plastic part 27 in the closing groove formed by projections 8 and 9. The profile bracket 26 with its projections oriented towards the door lays inside the groove formed by projections 8 and 9, so that the locked door cannot be opened if the locking element is cut with a knife.

The shaped profile door hinge 28 of plastic is screwed to the door frame 23 in a manner similar to the closing element 24. The U-shaped bracket 29 serves to fasten part 28 onto the door frame 23 with screws 30. The groove occupied by bracket 29 is closed by the flap 31 of profile 28. The hinge profile 28 exhibits a projecting continuation 32 which is fastened between the projection 35 and the clamping element 33 which is secured to the section 5 by means of screws 34. The door is appropriately swingable to the dotted position 32' through fastening of the door to the swingable elastic continuation 32. The fastened holding bracket 29 lays in the groove formed by the projections 35 of the profile section 5, so that the door cannot be opened illegally by cutting the continuation 32 in the area of the hinge. Shims 33' or other underlying pieces can be layed under the clamping member 33 while mounting the door.

By rotation of the locking element in the direction of arrow B, the member 24 comes disengaged from the groove formed by projections 8 and 9 so that the door can be opened in the direction of Arrow C.

The locking element 4 is performance-wise arranged around the rotation axis 7 in a swingable way which would prevent its displacement in an axial direction.

Figure 2:
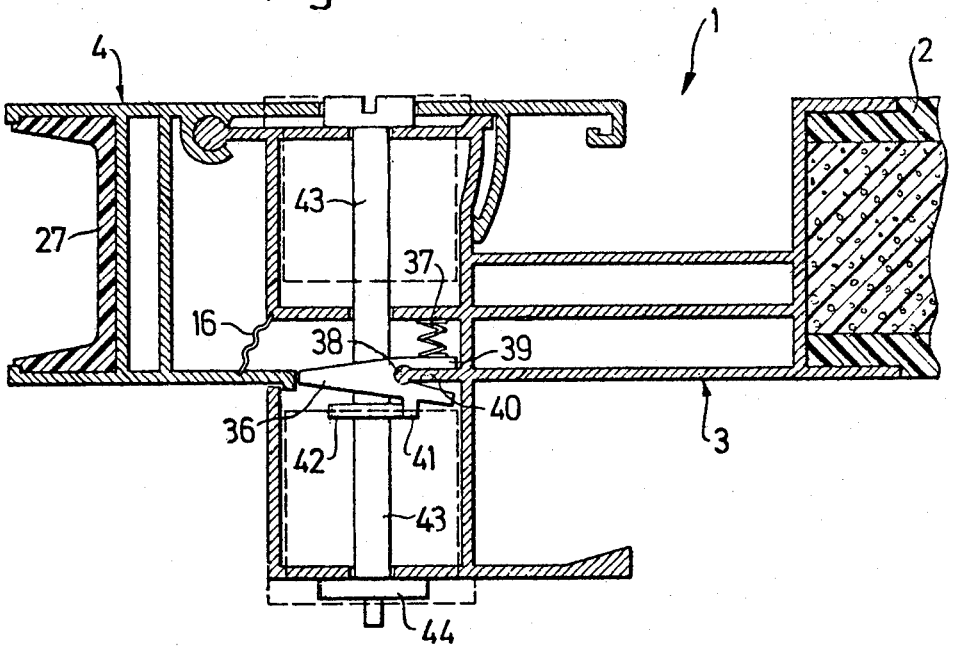
FIG. 2 is a section through the opening side of the door with a blocking mechanism.

A blocking member is shown in FIG. 2 for the door described in FIG. 1. The blocking element 36 is swingably arranged on a roll 38 which is on the end of a projection attached to section 3. The blocking element 36 exhibits a flat continuation 39 which in its locked attitude lays against the projection 40. The blocking element 36 is continuously biased in its locked attitude by means of a compression spring 37.

In section, the fork-shaped blocking element 36 exhibits on the shank opposite shank 39 a continuation 41, by which the blocking element 36 is movable into a non-blocking position by cam 42. The cam 42 is attached to shaft 43, which is arranged on the profile section 3, which is movable from one side of the door by means of grip 44. Also, grips can be provided on both sides of the door. The door shown in FIG. 2 can be opened only accordingly each time by means of turning the grip or handle 44. The door can be also held in a constantly unlocked condition, if the projection 41 is constantly held back by means of a turning of the cam 42.

Figure 3:
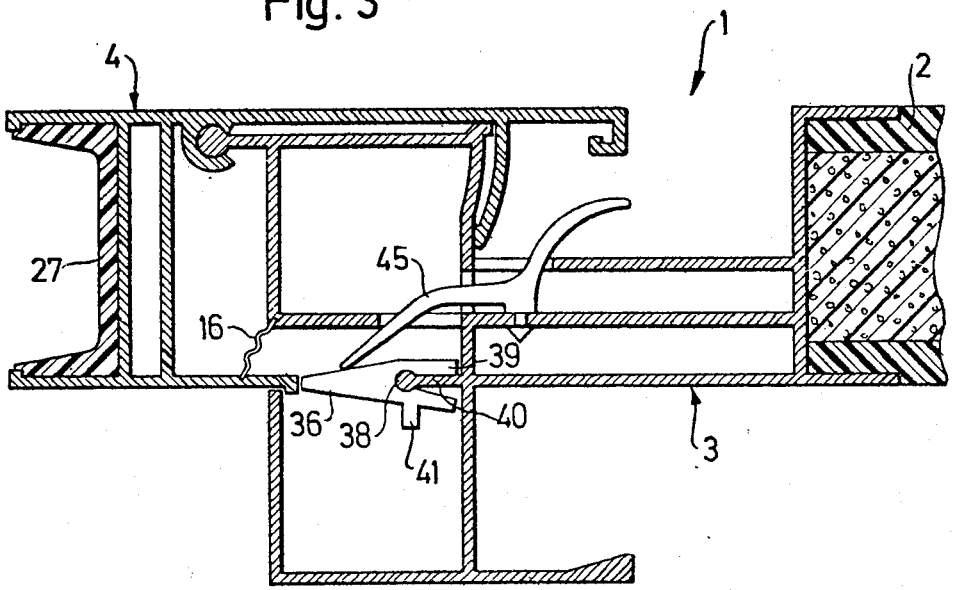
FIG. 3 is a section corresponding to FIG. 2, with a lever operating the opening mechanism.

An example of the door is shown in FIG. 3, by which the locking element 36 can be pressed into the open condition by means of the action of the double armed swing lever 45.

Figure 4:
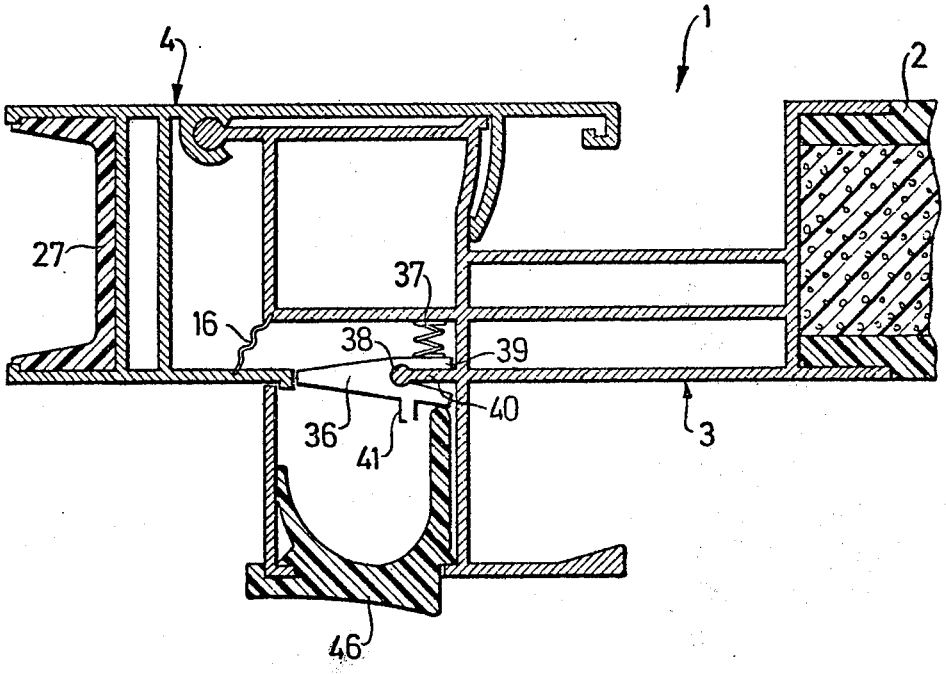
FIG. 4 is a section corresponding to FIG. 2, with a knob for opening of the door.

An example shown in FIG. 4 allows the blocking element 36 to be swung into its open condition from one side of the door by means of the button 46.

In FIG. 2, a key cylinder is shown dotted. After building in the aforementioned lock, the door can be locked or unlocked by means of customary keys. The continuation 41 can be rotated by the key (through) the acting cam 42.

Figure 5:
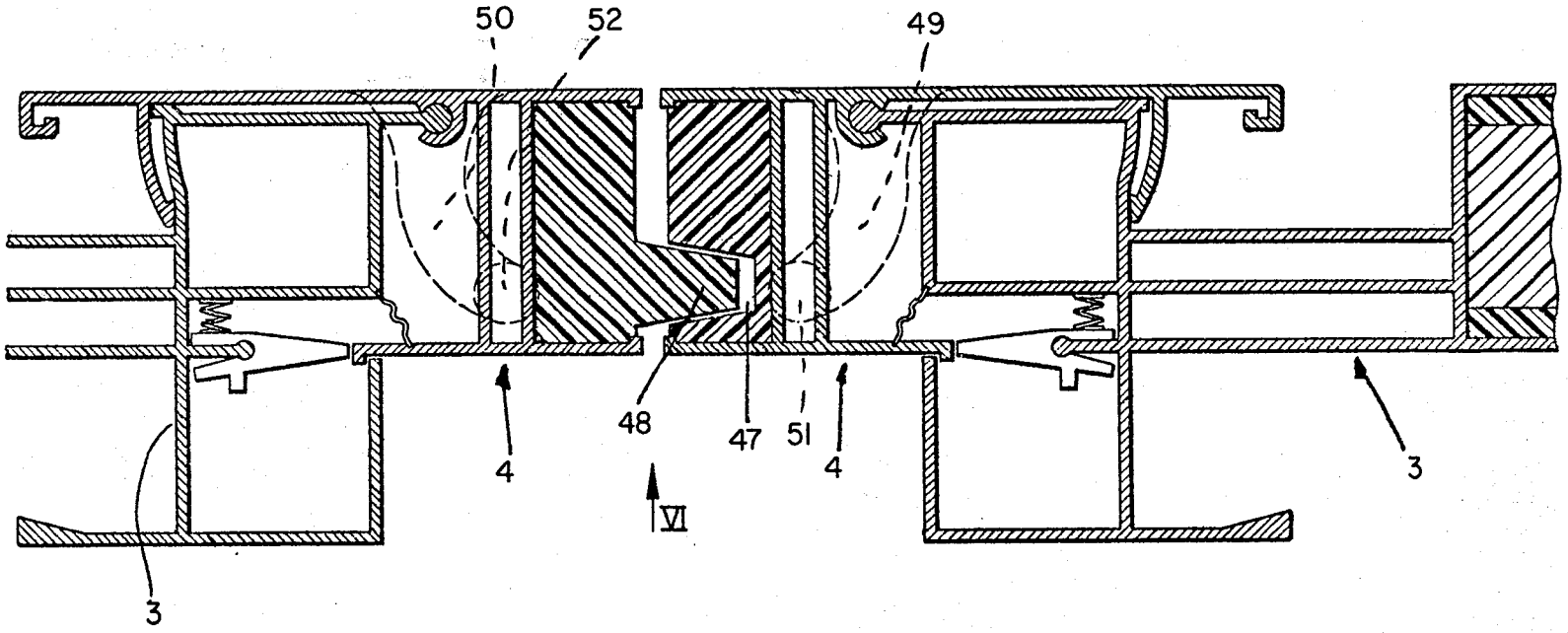
FIG. 5 is a partial section through a pair of doors at their meeting edges.

In FIG. 5 are shown the adjoining parts of each of two door leaves in a single frame. Each of the door leaves is situated in the door frame in a customary or in the described manner. The door body 2 of the door leaf is connected in the described way to the profile bracket 3. The locking element 4 is linked to the profile bracket 3 in the likewise described way. The locking elements 4 are provided on their respective related face sides with grooved elements that work together. In the illustrated example, these grooved elements consist of a groove 47 and an engaging element 48 that fits in the groove.

Figure 6:
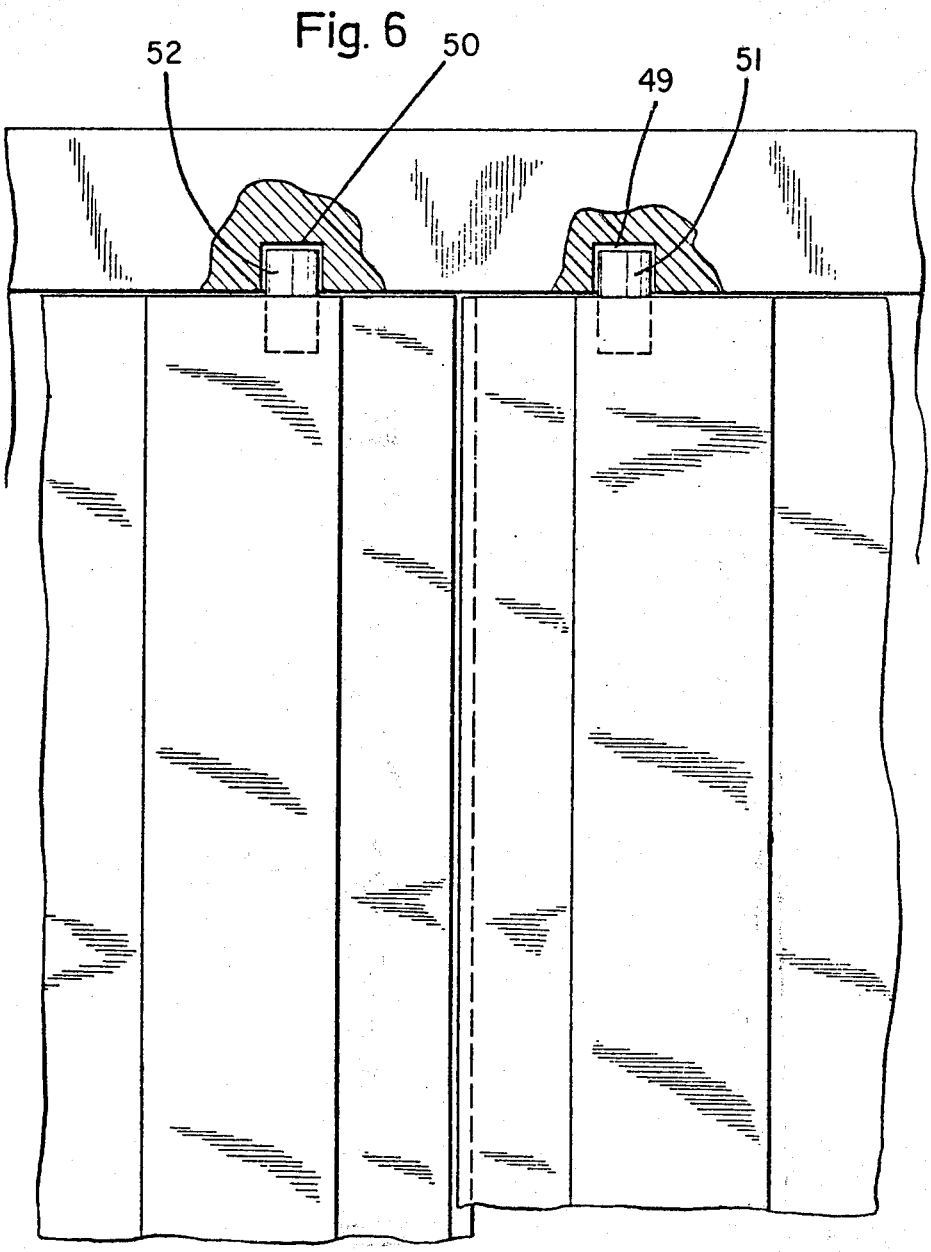
FIG. 6 is a partial elevation of the doors in FIG. 5.

Grooves 49 and 50 are provided in the upper part of the door frame as is visible in FIG. 6 and as drawn dotted in FIG. 5. These grooves form the guide for pins 51 and 52 which are fastened to the upper side of the locking element 4. The grooves 49 and 50 exhibit a curve which corresponds to the travel of pins 51 and 52 during opening and closing. In closing the doors, it makes no difference which leaf is closed first. Each leaf of the doors is arrested in its closed position by the pins 51 and 52 in grooves 49 or 50. The leaves of the doors can be opened or closed simultaneously, or also one after the other. In the closed condition, the leaves of the doors are engaged with one another.

Having described my invention, reference should now be had to the following claims:

I claim:

1. In a combination door and locking mechanism, wherein the door is hingedly connected to a door frame along one of its major longitudinal sides and the locking mechanism is operably connected to the opposed major longitudinal side of the door, the improvement of:

said locking mechanism including a longitudinal engaging element carried by said opposed door side and being hingedly mounted about a pivot axis which is generally parallel to the door hinge axis;

a corresponding longitudinal counter-element connected to a door frame and being generally parallel to and engageable with the engaging element;

said engaging element and counter-element extending substantially the entire height of the opposed door side;

said engaging element being channel-shaped in cross section and including a pair of spaced, longitudinal, substantially parallel projections extending away from the door;

said counter element being comprised of a male-shaped member nesting within said projections when the door is in the closed position;

said engaging element being in substantial planar alignment with the door when the door is in the closed position and being sufficiently pivotal in a direction opposite the door pivotal movement to pivot one of said projections out of lateral alignment with said counter element so that the door may open relative to the frame;

over center means for biasing said engaging element (a) in a closed position in substantial planar alignment with the door and nesting with the counter-element when the door is closed and (b) in a pivoted position whereby one of said projections is out of lateral alignment with the counter-element when the door is opened;

stop means carried by the door and movable therewith for restraining pivotal movement of the engaging element in one direction beyond the closed position;

blocking means operably connected with the door and selectively engageable with said engaging element for preventing pivotal movement thereof for locking the door in the closed position; and door opening means carried by said opposed door side and being pivotally mounted thereto, said opening means being operable with the engaging element for effecting pivotal movement of said engaging element upon manual operation of the opening means.

2. The combination as defined in claim 1, wherein the opening means includes a plate member rigidly connected to the engaging element, said plate and engaging element having a common pivotal mounting.

3. The combination as defined in claim 1, characterized by said over center biasing means including a spring interconnecting the engaging element and the door for selectively biasing said engaging element after sufficient movement passed dead center in opened or closed position.

4. The combination as defined in claim 2, characterized by said plate member terminating at its end away from the engaging element in a gripping element, and a recess in the door in general alignment with said gripping element to facilitate the grasping of said gripping element.

5. The combination as defined in claim 1, wherein the blocking means includes a member extending at least a part of the door height and being pivotally mounted on the door about a vertical axis; and manually operated means on said door for swinging the blocking member to a position for releasing said engaging element for pivotal movement.

6. The combination as defined in claim 5, wherein said manually operable means includes a lever movably mounted upon at least one side of the door, engageable with said blocking member.

7. The combination as defined in claim 5, characterized by said manually operable means including a cam movably mounted upon the door operatively engageable with said blocking member.

8. The combination as defined in claim 5, characterized by said manually operable means including a horizontal shaft extending through and rotatively mounted on said door, a cam on said shaft; a projection on said blocking member engageable with said cam, whereby rotation of said shaft selectively moves the blocking member to a released position.

9. A door with a connecting link to a door frame with a locking part on the closing edge of the door;

the improvement comprising a locking element movably connected to the door for at least a part of its height;

a longitudinal engaging element along the edge of the locking element;

a corresponding longitudinal counter-element upon said frame interlocking with said engaging element;

an elongated stop plate on said locking element registerable with one side of the door, limiting movement of the locking element in one direction beyond the closed position, an elongated plate joined to said stop plate and extending into a corresponding recess in said door to protectively cover a crack formed between the door and the locking element on swinging opening movement of the locking element, said plate being curved on a radius relative to the pivotal mounting of the locking element, and terminating in a lateral projection;

and a stop on the door registerable with said projection, limiting opening movement of the locking element;

said locking element being sufficiently movable in the opposite direction that the engaging element is disengaged from said counter-element, permitting the door to open relative to the frame.

10. A door consisting of two aligned leaves which are hingedly mounted to a door frame at respective, opposed ends thereof by respective connecting links, the improvement comprising a locking mechanism pivotally interconnected between the door leaf edges for at least a part of their height;

a longitudinal engaging element pivotally mounted along the edge of one of said door leaf edges;

a corresponding longitudinal counter-element pivotally mounted on the edge of the other door leaf interlocking with said engaging element;

the interlocking between the longitudinal engaging element and the corresponding longitudinal counter-element including cooperating tongue and groove elements mounted upon the respective members; and a stop on said locking mechanism registerable with said one side of one of the door leaves, limiting movement of the locking mechanism in one direction beyond the closed position;

said longitudinal engaging element and the corresponding longitudinal counter-element being sufficiently pivotal to become disengaged from one another, permitting the door leaves to open relative to one another.

11. In the door of claim 10, and a pin and lock connection between at least one of said leaves and the head or threshold of said frame.

12. In the door of claim 11, there being a pair of slot connections for both of said leaves, said connection comprising an upright pin secured to each locking element, movably nested in an undercut groove in the head of said frame, said grooves being curved corresponding to the swinging motion of the pins on opening of the door leaves.

13. The combination as defined in claim 1, characterized by said blocking means including a pivotally mounted member extending at least a part of the door height; and manually operable means for swinging the blocking member into and out of engagement with said longitudinal engaging element.

14. In the door of claim 13, spring means biasing said blocking member to locking position.

15. In a combination door and locking mechanism, wherein the door is hingedly connected to a door frame along one of its major longitudinal sides and the locking mechanism is operably connected to the opposed major longitudinal side of the door, the improvement of:

said locking mechanism including a longitudinal engaging element carried by said opposed door side and being hingedly mounted about a pivot axis which is generally parallel to the door hinge axis;

a corresponding longitudinal counter-element connected to a door frame and being generally parallel to and engageable with the engaging element;

said engaging element and counter-element extending substantially the entire height of the opposed door side, one of said elements being channel-shaped in cross-section and including a pair of spaced, longitudinal substantially parallel projections, the other of said elements being comprised of a male-shaped member nesting within said projections when the door is in the closed position, said engaging element being sufficiently pivoted in a direction opposite the door pivotal movement to accommodate disengagement of said male-shaped and channel-shaped members so that the door may open relative to the frame;

stop means carried by the door and movable therewith for restraining pivotal movement of the engaging element in one direction beyond the closed position;

blocking means carried by the door and movably mounted thereto for selectively preventing pivotal movement of the engaging element for locking the door in the closed position; and door opening means carried by said opposed door side and being pivotally mounted thereto, said opening means being operable with the engaging element for effecting pivotal movement of said engaging element upon manual operation of the opening means.

* * * * *